US012528007B2

(12) United States Patent
Wilhelm

(10) Patent No.: US 12,528,007 B2
(45) Date of Patent: Jan. 20, 2026

(54) RACK FOR ACCOMMODATING FITNESS EQUIPMENT

(71) Applicant: Richard Wilhelm, Munich (DE)

(72) Inventor: Richard Wilhelm, Munich (DE)

(73) Assignee: Richard Wilhelm, Munich (DE)

( * ) Notice: Subject to any disclaimer, the term of this patent is extended or adjusted under 35 U.S.C. 154(b) by 59 days.

(21) Appl. No.: 18/716,341

(22) PCT Filed: Dec. 7, 2022

(86) PCT No.: PCT/EP2022/084814

§ 371 (c)(1),
(2) Date: Jun. 4, 2024

(87) PCT Pub. No.: WO2023/104893

PCT Pub. Date: Jun. 15, 2023

(65) Prior Publication Data

US 2025/0041699 A1 Feb. 6, 2025

(30) Foreign Application Priority Data

Dec. 8, 2021 (DE) ..... 10 2021 132 269.3

(51) Int. Cl.
*A63B 71/04* (2006.01)

(52) U.S. Cl.
CPC ..... *A63B 71/04* (2013.01)

(58) Field of Classification Search
CPC ..... A63B 17/02; A63B 71/04; A63B 2210/06; A63B 2225/09; A63B 2225/12; A63B 2225/685
See application file for complete search history.

(56) References Cited

U.S. PATENT DOCUMENTS

| | | | | |
|---|---|---|---|---|
| 7,374,516 | B2 | 5/2008 | Lundquist | |
| 7,930,857 | B2 * | 4/2011 | Pope | E04B 1/3431 52/79.5 |
| 8,650,806 | B1 * | 2/2014 | Condie | E04H 1/1277 52/79.5 |
| 9,458,621 | B2 * | 10/2016 | Calafatis | E04B 1/34336 |
| 9,750,999 | B2 * | 9/2017 | Monaco | A63B 71/023 |
| 9,862,299 | B2 * | 1/2018 | Johnson | B60P 3/00 |
| 11,220,816 | B2 * | 1/2022 | Tiramani | E04B 1/34384 |
| 2007/0079573 | A1 * | 4/2007 | Sarine | E04B 1/34305 52/592.1 |
| 2007/0270292 | A1 | 11/2007 | Laney | |
| 2014/0150352 | A1 * | 6/2014 | Lee | E04B 1/3444 52/79.5 |

(Continued)

FOREIGN PATENT DOCUMENTS

| | | |
|---|---|---|
| CN | 1 07 695 977 A | 2/2018 |
| DE | 72 21 839 U | 12/1972 |
| DE | 35 03 989 A1 | 8/1986 |

(Continued)

*Primary Examiner* — Joshua Lee
(74) *Attorney, Agent, or Firm* — Colson Law Group, PLLC

(57) ABSTRACT

A rack for accommodating fitness equipment comprising two lateral frames arranged parallel to one another and a rear frame connecting the lateral frames to one another. According to the invention, in order to easily operate a rack of this type and to be able to integrate it into a living space, the two lateral frames can be pulled out via the front side of the rack.

7 Claims, 5 Drawing Sheets

(56) References Cited

U.S. PATENT DOCUMENTS

| | | | | |
|---|---|---|---|---|
| 2020/0384837 | A1 | 12/2020 | Singer | |
| 2023/0173971 | A1 * | 6/2023 | Factor | A63B 22/00 280/204 |

FOREIGN PATENT DOCUMENTS

| | | | | |
|---|---|---|---|---|
| DE | 200 06 297 | U1 | 4/2001 | |
| DE | 695 27 151 | T2 | 1/2003 | |
| DE | 20 2019 001 100 | U1 | 4/2019 | |
| WO | WO-9618785 | A1 * | 6/1996 | A47B 88/42 |
| WO | 2014/128570 | A2 | 8/2014 | |

* cited by examiner

RACK FOR ACCOMMODATING FITNESS EQUIPMENT

The invention relates to a rack for accommodating fitness equipment, comprising two lateral frames arranged parallel to one another, and a rear frame connecting the lateral frames to one another.

To set up a fitness room, especially a private home fitness room, in addition to providing the appropriate fitness equipment, such as barbells and weight plates, horizontal bars, ropes, cable pulleys, etc., a frame is usually also required, which, on the one hand, serves as a basic structure for performing various fitness exercises, and on the other hand, functions to hold, i.e. to attach or store, the fitness equipment and any accessories. Such a rack is also known as a "power rack" in professional circles. Therefore, the terms "rack" and "power rack" are used synonymously hereinafter.

Often, standard commercially available power racks cannot be integrated into a normal living environment, but require their own room. The reason for this is, on the one hand, the space required to set up the power rack and carry out the exercises, and on the other hand, its visual design. A power rack is therefore perceived as a disruptive factor in most living spaces. Even in rooms predestined for this purpose, such as basements, the space requirement makes it difficult or impossible to use a power rack, especially in urban areas with limited space.

Various racks ("power racks") of the type mentioned above are known in the state of the art. For example, U.S. Pat. No. 7,374,516 B2 shows a frame with two lateral frames and a rear frame, in which a fitness device in the form of a barbell guide is movably mounted. The well-known power rack requires a lot of space.

WO 2014/128570 A2 also discloses a rack that can be folded up outside of usage times. The disadvantage of this power rack is the high effort required to set it up and dismantle it.

The invention is therefore based on the object of specifying a generic rack that can be operated with little effort and can be integrated into a living space.

To achieve the above-mentioned object, a rack is designed according to the features of independent claim 1. Advantageous embodiments are specified in the dependent claims.

According to the invention, the two lateral frames can be extended via the front side of the rack.

The embodiment of the rack, according to the invention, thus solves the above-mentioned problem by being convertible from a "resting state" to a "training state" and vice versa. In the resting state, it forms a space limited by the rear frame and the two lateral frames with a comparatively small space requirement, which can be enlarged to a size appropriate for training by simply extending the lateral frames via the front side of the rack when in the training state. The solution, therefore, consists of a minimizable power rack that can be extended for training by pulling out the lateral frames. When not in use, however, it can be integrated into the living space to save space. The space inside the minimized power rack can be used to store fitness equipment, such as weights, barbells, and a weight bench, so that no complex assembly and disassembly process is necessary, and no separate space has to be provided for storing the fitness equipment.

The lateral frames can, for example, be designed consisting of several parts and having a sliding system that allows them to be pulled out-similar to a drawer. Alternatively, the lateral frames can also have a telescopic guide, the interlocking components of which can be pulled apart to extend or pushed into one another to achieve the resting state. In addition, the movement for extending or sliding in the lateral frames can be carried out manually or by means of an electric drive, e.g. a linear motor.

According to the invention, the two lateral frames are connected to one another at their upper side by a top part.

In this manner, additional stiffening of the frame can be achieved in a simple manner.

Specifically, it is provided that the top part is designed in two pieces, with a first piece being firmly connected to the lateral frames and a second piece being connected to the first piece at the front of the rack by means of a hinge in such a manner that it rests on the lateral frames when the lateral frames are extended and unfolded.

This embodiment enables space-saving integration of the top part into the frame, and also makes it easy to handle; as all you have to do to get the power rack into training mode is to open up the top part and pull out the lateral frames. Furthermore, the required stabilization of the rack is achieved by resting on it in its extended state.

In this context, it is intended that the second piece of the top part has guide rails on both sides, in which the lateral frames are guided when pulled out and in its extended state.

This can further simplify the handling of the rack when establishing the training condition with additional stabilization. This largely prevents accidental incorrect joining of the top part and the lateral frame.

In addition, the top part can be provided with cross-bracing. Such cross braces can be used not only to provide the necessary stiffening of the rack, but also to perform fitness exercises. For this purpose, the cross braces can be designed as pull-up bars and/or hanging bars, for example.

A further advantageous embodiment of the rack according to the invention provides that the rear frame and/or at least one of the lateral frames has fastening devices for mounting fitness equipment and/or storage means.

This means that the rack can also be used as a storage space for fitness equipment and/or accessories. This is particularly useful when the power rack is not in use, as it allows the fitness equipment and accessories to be stored almost invisibly, since no additional storage space is required. Fastening devices can be, for example, holes and slots into which mounting devices for fitness equipment or accessories engage, and which are fastened, for example, by screwing. Likewise, clamping elements and/or hooks can be provided as fastening devices. This allows the rack to be adapted in a variety of ways to store any fitness equipment and/or accessories.

In order to ensure particularly good integration of the rack according to the invention into a living environment, it can also be provided that the rear frame and/or the lateral frames are covered on the outside.

In this manner, the rack can take the form of a cupboard, which is usually more acceptable in a living environment.

The outer panel of the rack can also be provided with additional elements, e.g. shelves and/or fastenings for home electronics or TV, in order to enable multiple use of the rack in accordance with this embodiment.

Specifically, it can also be provided that the rack has at least one pivoting door on its front side. This means that the rack and any contents can be completely concealed when it is not in use. To establish the training state, at least one door, which can preferably be a hinged or folding door, is opened as wide as possible. The side frames are then pulled out from the front.

In accordance with a further advantageous embodiment of the rack according to the invention, it can be provided that the rear frame is mirrored on its surface facing the front of the rack.

This allows for self-monitoring of the exercises during training. In addition, an optional interior lighting of the rack can provide sufficient illumination of the training area even if there is no or insufficient room lighting.

Finally, in order to be able to carry out training exercises without being affected by adverse weather or blinding sunlight when the rack is used outdoors, a roller shutter-like covering can be provided, which can be pulled out from the top of the rack to protect it from the weather. This can create a kind of extendable roof for the rack. When retracted, the roller shutter cover also protects the rack from the effects of the weather.

The invention is explained in more detail below using exemplary embodiments. The exemplary embodiments serve only to explain individual embodiments of the invention. Elements of the exemplary embodiments can be combined with one another in any manner within the scope of the invention.

In the figures

Identical or corresponding elements are designated by the same reference numerals in the figures.

Figure 1:
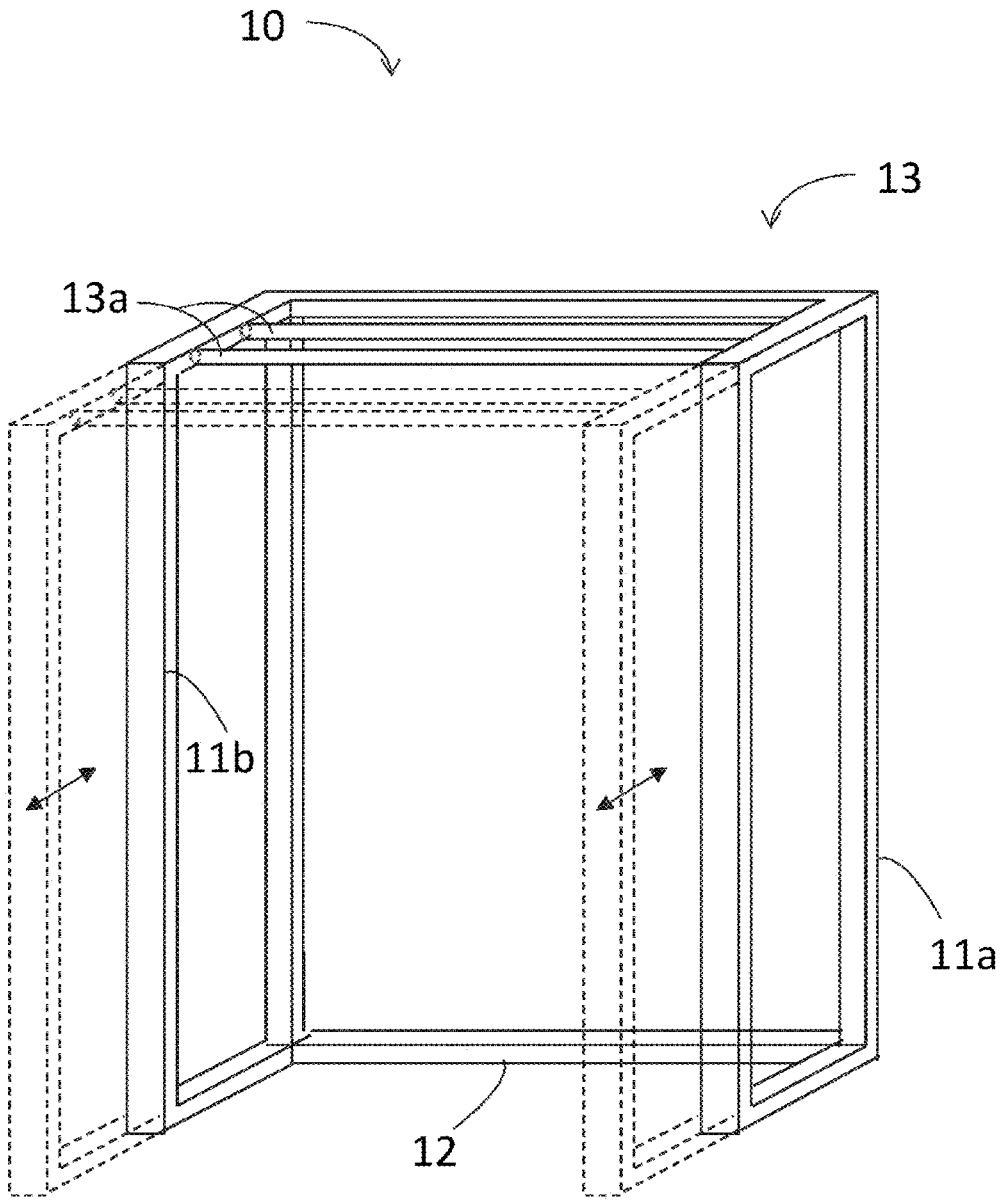
FIG. 1 shows a first exemplary embodiment of a power rack.

FIG. 1 shows a first exemplary embodiment of a rack 10 for holding fitness equipment and performing fitness exercises ("power rack"). The exemplary embodiment in FIG. 1 represents a basic version of the rack 10. The rack 10 has two lateral frames 11*a*, 11*b*, which are connected to one another by a rear frame 12. Lateral frames 11*a*, 11*b* and rear frame 12 can be made of stainless steel, for example, and can be connected to one another in a torsion-resistant manner by means of screw, plug, or weld connections. For further stabilization, a top part 13 may be present, to which the two side frames are connected at the top. The top part 13 can be formed, for example, by cross braces 13*a*, which, in addition to their stabilizing function, can also be used to carry out fitness exercises, such as hanging and/or pull-ups. Optionally, the stability of the rack 10 can be further increased by a base (not shown in FIG. 1).

The rack 10 in FIG. 1 is shown in solid lines in its resting state. The lateral frames 11*a*, 11*b* can be converted from this resting state to a training state by pulling them out beyond the front of the rack 10, as indicated by dashed lines in FIG. 1. The lateral frames 11*a*, 11*b* can be pulled out manually. Alternatively, a motorized drive can be provided, for example, in the form of a linear drive or a chain drive.

The power rack forms the basic building block of a fitness center, especially a home fitness center, which can be integrated into a normal living environment and which requires little space when not in use. A modular product and service landscape can be designed around such a minimizable power rack, allowing the user to gradually add new training equipment and gradually acquire new training functions.

For this purpose, the rack 10 includes fastening devices with which holding means (hooks, bars, etc.) for training equipment and accessories can be attached to the rack. The rack 10 can be used, for example, to hold barbell racks ("J-hooks" or "spotter bars"). Furthermore, holding devices for further exercises, such as "Landmine row" or "Battle rope", can be available-either as an option for retrofitting or already provided at the factory. To be able to train online with a personal trainer, cameras can be mounted at different points on the rack 10 in order to be able to remotely assess and guide the movements of a person training.

The power rack can also be optionally equipped with cable pulls on both the left and right, either at the factory or later, which can be used for further training exercises. These cable pulls are, for example, each mounted in a holder that can be attached to the outside of the two extendable lateral frames 11*a*, 11*b*. Alternatively or additionally, training equipment for barbell training can also be provided. In order to create training space for barbell training when the cable pulls are installed at the same time, the attached holders with built-in cable pulls can be folded away (forwards or backwards). It is also possible to mount a barbell guide at the front end of the lateral frames 11*a*, 11*b* as on a Smith machine (multi-press). This option can also be pre-installed at the factory or retrofitted. The Smith machine module comes with a plate that can be mounted on the barbell, allowing it to be used as a leg press as well. In order to be able to perform cardio exercises, a rowing sled can also be provided, which can be used, for example, to row on the above-mentioned cable pull. Like the other accessories, this rowing sled can be stored in the power rack (e.g. folded away) when the rack is in a resting state.

Figure 2:
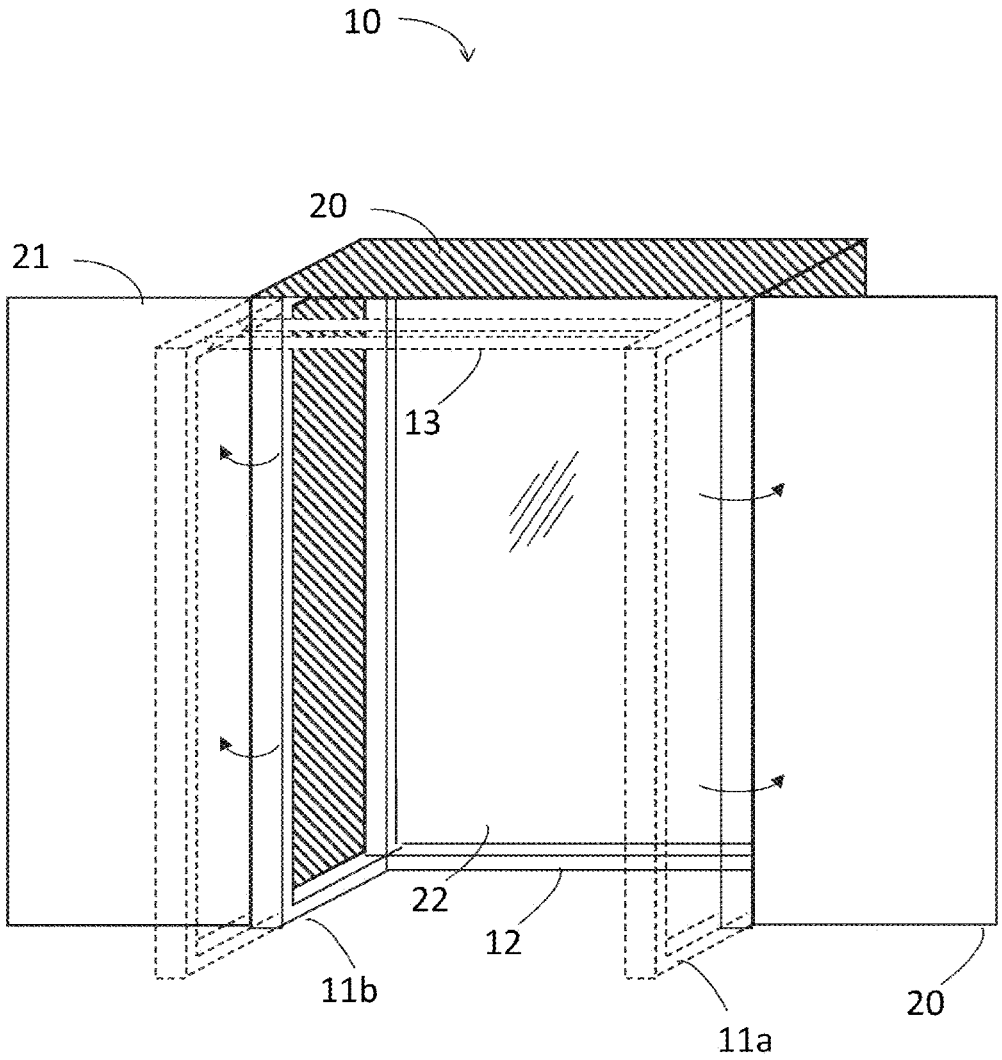
FIG. 2 shows a second exemplary embodiment of a power rack.

FIG. 2 shows a second exemplary embodiment of a power rack. The rack 10 shown in FIG. 2 initially comprises the same components as the exemplary embodiment shown in FIG. 1, so that it comprises a rear frame 12 and two extendable lateral frames 11*a*, 11*b*. In order to be able to integrate the power rack even better into a living space, the rack 10 in the exemplary embodiment of FIG. 2 has a covering 20 (indicated by hatching). This can be, for example, a wooden or plastic covering of the side, back, and/or top surfaces of the rack 10, which has an exterior design of the rack 10 that is adapted to the living space, for example, a color and/or grain that matches other furniture. Doors 21, e.g. hinged or folding doors, can also be provided on the front side of the rack 10. These doors 21 can be closed in the resting state (with the lateral frames 11*a*, 11*b* pushed in), so that the rack 10 takes on the external appearance of a cabinet, which at the same time offers a storage place for training equipment and accessories that cannot be seen from the outside. To establish the training state, the doors 21 are opened (as indicated by arrows in FIG. 2) in order to be able to pull the lateral frames 11*a*, 11*b* out to the front. In the process, any braces on the top part 13 are also exposed so that they can be used for exercises. The front covering in the form of one or two doors can also fulfill various additional functions and can be used, for example, as a TV stand, bookshelf, or projection surface for a projector. The outer side walls of the covering can also be used as shelves.

The inside of the rear frame 12 can also be partially or fully equipped with a mirror 22, which allows the user to self-check training exercises. With a rear covering, rack 10 can also be used as a kind of room divider.

In order to protect the floor in the living environment, a foldable sports floor can be provided inside the rack 10.

The rack 10 can contain an organization system for weights, bars, weight bench, and other accessories, so that the complete fitness center can be stored like in a closet.

Figure 3:
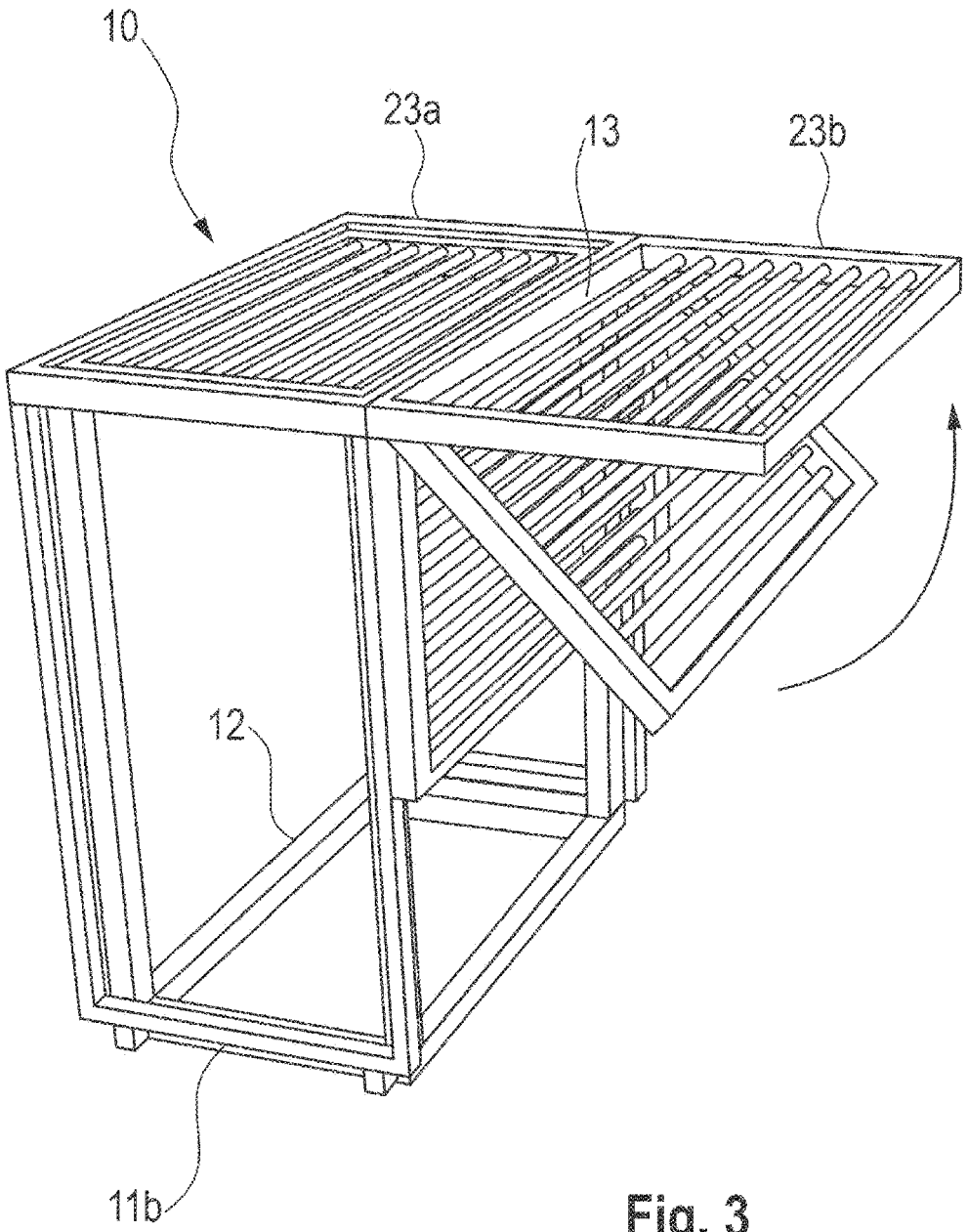
FIGS. 3 and 4 show schematic diagrams that explain a transition of a power rack from a resting state to a training state.
Figure 4:
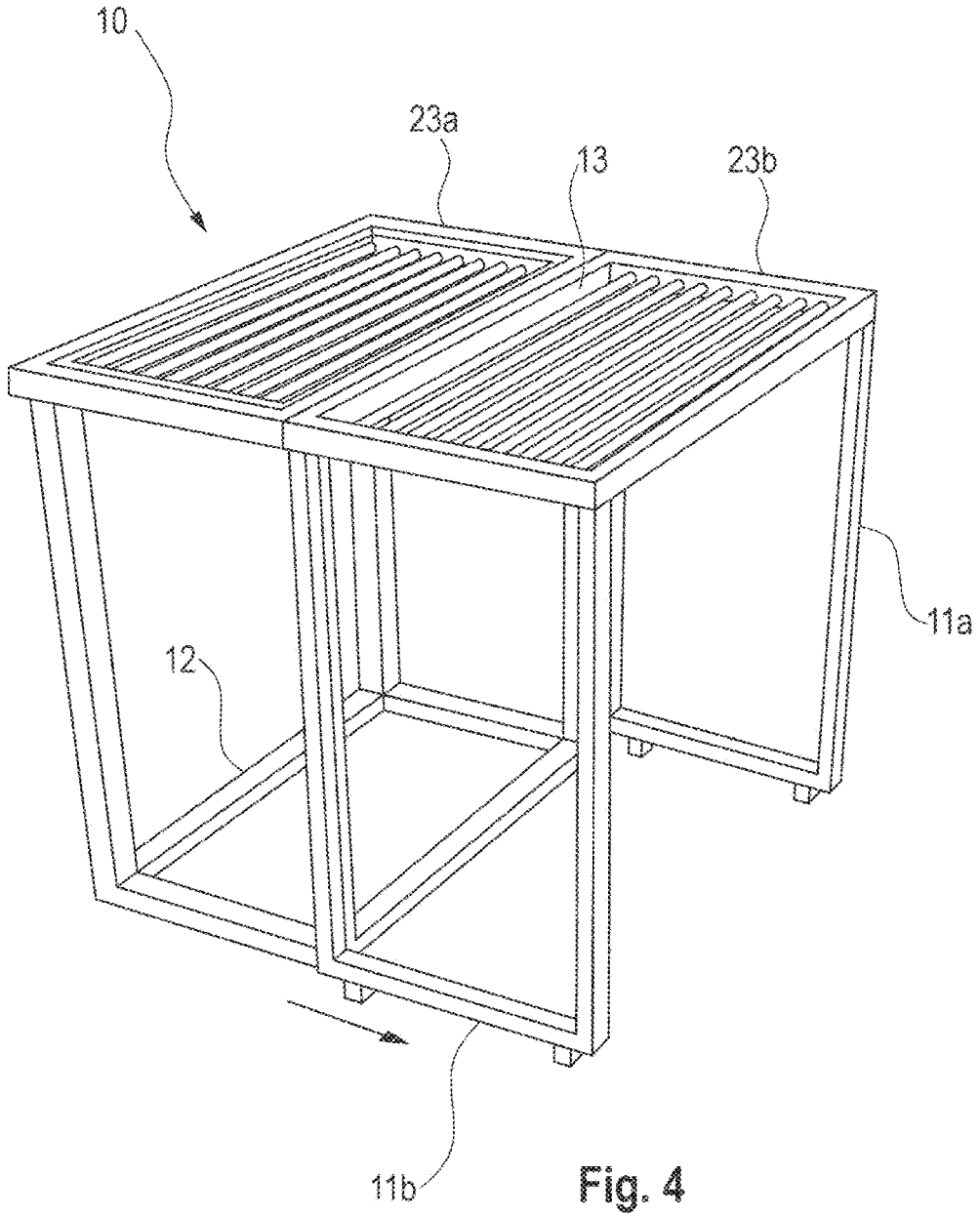

FIGS. 3 and 4 show schematically the transition of the rack 10 from its resting state to its training state. A special feature of the rack 10 shown in FIGS. 3 and 4 is a two-part top part 13, which can be unfolded to establish the training state. As can be seen in FIG. 3, the top part 13 has a first part 23*a*, which is mounted on the lateral frames 11*a*, 11*b*, and the rear frame 12. For example, the first part 23*a* can be bolted or welded to the frame of the rack 10. A second part 23*b* is connected to the first part 23*a* by a hinged connection. The connection can be created, for example, by one or more hinges. In the resting state, the second part 23*b* is folded down. To establish the training state, it is folded upwards as indicated by the arrow in FIG. 3 until it forms a plane with the first part 23*a*.

Thereafter, the lateral frames 11*a* and 11*b* are extended manually or by motor, as already explained in relation to FIGS. 1 and 2, beyond the front side of the rack 10 (see the arrow in FIG. 4). To support the extension movement and provide additional stabilization, guide rails can be provided on the underside of the second part 23*b* of the top part 13, in which the lateral frames 11*a*, 11*b* are guided. After the lateral frames 11*a*, 11*b* are completely pulled out, the second part 23*b* rests on the lateral frames 11*a*, 11*b*.

To establish the resting state, the described steps are carried out in reverse order, i.e. the lateral frames 11*a*, 11*b* are pushed in the direction of the rear frame 12 and the second part 23*b* of the top part 13 is folded in. If the power rack is covered as shown in FIG. 2, care must be taken when installing the doors to ensure that the second part 23*b*, which is to be folded in, has sufficient freedom of movement.

Figure 5:
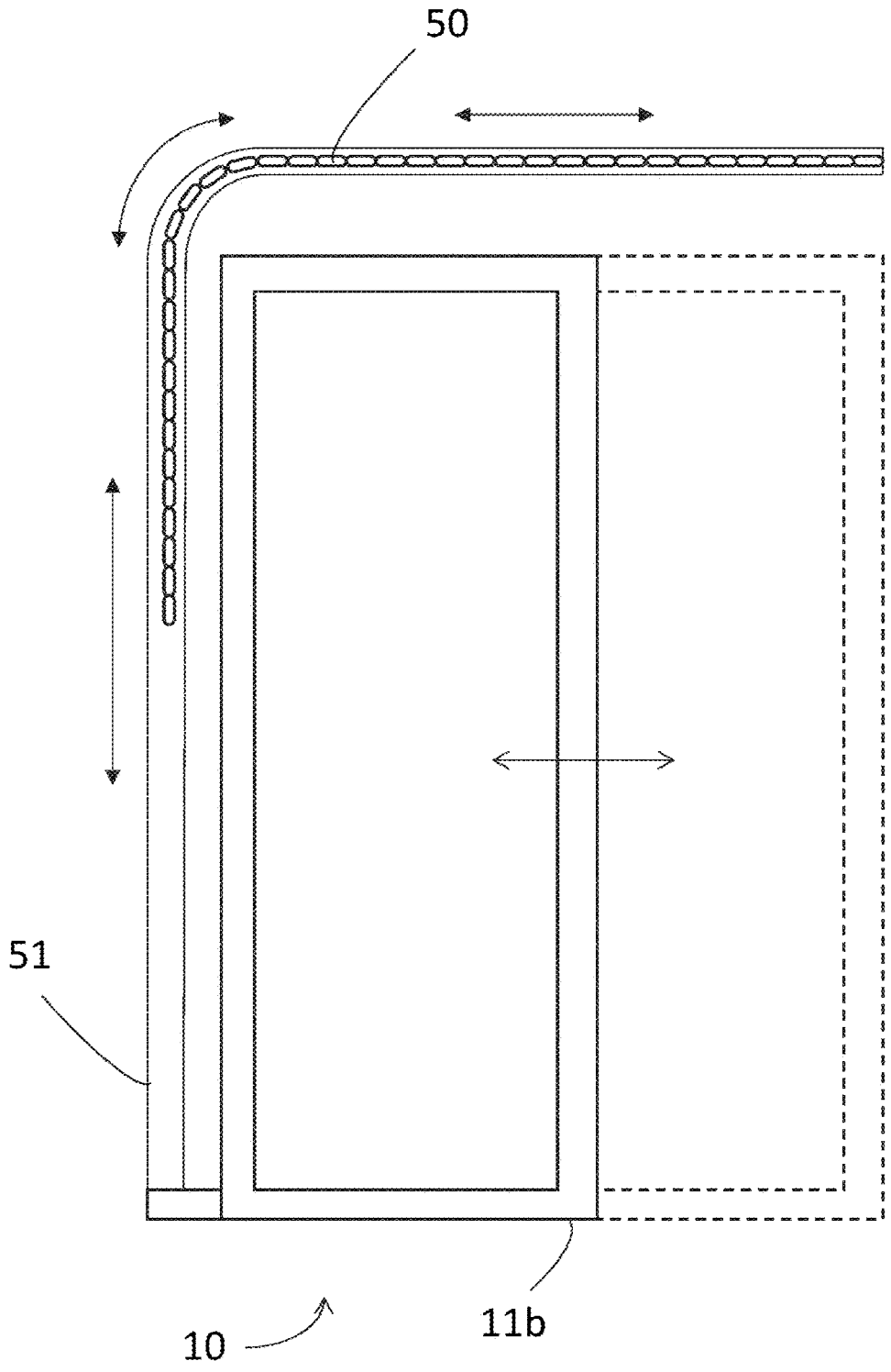
FIG. 5 shows a schematic representation of a power rack with a covering for outdoor installation.

Finally, FIG. 5 shows an outdoor variant of the rack 10 in a side view. In this variant, the rack 10 is set up outside a living space in the open air, e.g. in the garden of a residential building. In order to protect the rack 10 from weather and climatic influences, on the one hand, and to be able to carry out training even in adverse weather conditions (rain, snowfall, strong sunlight), on the other hand, a roller shutter-like covering 50 is provided, which is guided in a holding device 51 in such a manner that it protects the rack from external influences in its resting state, on the one hand, and forms a protective roof in an extended state, on the other hand, so that a person training can carry out exercises unhindered. The weatherproof covering, created in this manner, can be opened to create a training space depending on the weather conditions. The mechanism of the roller shutter-like covering 50 is similar to that of a roller shutter box. However, the roller shutter in rack 10 does not serve as a front covering, but as an extendable roof as described. When closed, the roller shutter is lowered down to the back of the power rack. The front covering, for example, consists of doors that can be opened to the side, like a cabinet. When opened, the doors represent the left and right outer walls of a mini training hall; the roller shutter roof then rests on these side walls, creating a training room that is open to the front and contains the power rack. The doors can contain pull-out elements that can be pulled out to the front like sliding doors and then folded in to the side. This creates an enclosed training room. In order to be able to train even in the cold season, a heating system, e.g. with infrared radiators, can be provided.

The invention claimed is:

1. A frame for supporting fitness equipment with two side frames arranged parallel to one another and a back frame connecting the side frames to one another; wherein the two side frames can be extended beyond a front of the frame, the two side frames are connected to one another at their upper side by a cover part, the cover part is designed in two parts, wherein a first part is firmly connected to the side frames and a second part is foldably connected to the first part at the front of the frame in such a way that, when the side frames are extended, the second part rests on the side frames when folded out, and that the second part of the cover part has guide rails on both sides in which the side frames are guided when extended and in an extended state.

2. The frame according to claim 1, wherein the cover part has cross braces.

3. The frame according to claim 1, wherein the back frame and/or at least one of the side frames has fastening devices for mounting fitness equipment and/or storage means.

4. The frame according to claim 1, wherein the back frame and/or the side frames are covered on the outside.

5. The frame according to claim 1, wherein the frame has at least one pivotable door on its front side.

6. The frame according to claim 1, wherein the back frame is mirrored on its surface facing the front of the frame.

7. The frame according to claim 1, wherein a roller shutter-like covering is provided which can be pulled out at a top of the frame as weather protection.

* * * * *